US011528942B2

(12) United States Patent
Qiu et al.

(10) Patent No.: US 11,528,942 B2
(45) Date of Patent: Dec. 20, 2022

(54) VOLTAGE OUTPUT CIRCUIT AND ATOMIZING DEVICE

(71) Applicant: Changzhou Patent Electronic Technology Co., LTD., Changzhou (CN)

(72) Inventors: Weihua Qiu, Changzhou (CN); Chunjie Ou, Changzhou (CN)

(73) Assignee: CHANGZHOU PATENT ELECTRONIC TECHNOLOGY CO., LTD., Changzhou (CN)

( * ) Notice: Subject to any disclaimer, the term of this patent is extended or adjusted under 35 U.S.C. 154(b) by 387 days.

(21) Appl. No.: 16/643,838

(22) PCT Filed: Dec. 18, 2017

(86) PCT No.: PCT/CN2017/116870
§ 371 (c)(1),
(2) Date: Mar. 2, 2020

(87) PCT Pub. No.: WO2019/041655
PCT Pub. Date: Mar. 7, 2019

(65) Prior Publication Data

US 2021/0059312 A1 Mar. 4, 2021

(30) Foreign Application Priority Data

Sep. 1, 2017 (CN) ..... 201721124057.8

(51) Int. Cl.
*A24F 40/57* (2020.01)
*A24F 40/10* (2020.01)
*H05B 1/02* (2006.01)

(52) U.S. Cl.
CPC ..... *A24F 40/57* (2020.01); *A24F 40/10* (2020.01); *H05B 1/0244* (2013.01); *H05B 2203/005* (2013.01)

(58) Field of Classification Search
CPC ..... H05B 1/0227; H05B 1/0244; H05B 2203/005
See application file for complete search history.

(56) References Cited

FOREIGN PATENT DOCUMENTS

| | | | | |
|---|---|---|---|---|
| CN | 104853506 A | | 8/2015 | |
| CN | 206515724 U | * | 9/2017 | |
| CN | 107484305 A | * | 12/2017 | ..... H05B 33/0815 |
| DE | 112015004064 T5 | | 5/2017 | |
| JP | 2016-57685 A | | 4/2016 | |
| WO | 94/06314 A1 | | 3/1994 | |
| WO | 98/17130 A1 | | 4/1998 | |
| WO | 01/70054 A1 | | 9/2001 | |

* cited by examiner

*Primary Examiner* — Jean F Duverne
(74) *Attorney, Agent, or Firm* — Cheng-Ju Chiang

(57) ABSTRACT

Provided is a voltage output circuit. The voltage output circuit includes a processing module and N output modules, N is an integer greater than 1. The processing module includes N output ends. The N output terminals of the processing module are correspondingly connected to the N output modules, and the N output terminals of the processing module are used for respectively output control signals so as to control the corresponding output modules to output drive voltages. The voltage output circuit is provided with multiple output modules respectively controlled by multiple control signals, so that the voltage output circuit is capable of respectively providing drive voltages to multiple apparatuses of one device, and has good compatibility and high flexibility.

15 Claims, 2 Drawing Sheets

VOLTAGE OUTPUT CIRCUIT AND ATOMIZING DEVICE

CROSS REFERENCE TO RELATED APPLICATION

The present application is a 35 U.S.C. § 371 National Phase conversion of International (PCT) Patent Application No. PCT/CN2017/116870, filed on Dec. 18, 2017, which is based on and claims priority of Chinese patent application No. 201721124057.8, filed on Sep. 1, 2017. The entire disclosure of the above-identified application is hereby incorporated by reference herein and made a part of this specification.

TECHNICAL FIELD

The invention relates to the technical field of power sources, in particular to a voltage output circuit and an atomizing device.

BACKGROUND TECHNIQUE

As a substitute for tobacco products, e-cigarettes have become a kind of use equipment that more and more people carry with them because they are easy to use and have a large amount of smoke. Generally, when the user smokes the electronic cigarette, the atomizer is configured to atomize the smoke oil disposed in the electronic cigarette. With the variety of atomizers, there are more and more ways to heat the atomizer.

SUMMARY OF THE INVENTION

The invention provides a voltage output circuit and an atomizing device, which can respectively provide a drive voltage to N apparatus (for example, heating apparatus) in a device (for example, an atomizing device), which has good compatibility and high flexibility.

The technical solution is as follows:

The invention provides a voltage output circuit, wherein the voltage output circuit includes a processing module and N output modules, N is an integer greater than 1; the processing module includes N output terminals, and each output terminal of the N output terminals of the processing module is respectively connected to a different one of the N output modules, and the N output terminals of the processing module are respectively configured to output a control signal to control a corresponding output module output drive voltage.

In an embodiment, each output module includes an output control unit and a switch unit, and the output control unit is electrically connected to the switch unit, and configured to output the drive voltage according to the control signal outputted by an output terminal of the processing module; a first input terminal of the output control unit is electrically connected to the output terminals of the processing module to receive the control signal, and the output control unit includes a third output terminal and a fourth output terminal; the switch unit receives a first DC input voltage and is connected to the third output terminal and the fourth output terminal to output the drive voltage.

In an embodiment, the switch unit includes a first switch sub-unit and a second switch sub-unit, and the first switch sub-unit includes a first connecting terminal, a first control terminal, and a second connecting terminal, and the second switch sub-unit includes a third connecting terminal, a second control terminal, and a fourth connecting terminal, the first connecting terminal receiving the first DC input voltage, the first control terminal is electrically connected to the third output terminal of the output control unit, the second connecting terminal is electrically connected to the third connecting terminal, the second control terminal is electrically connected to the fourth output terminal of the output control unit, and the fourth connecting terminal is grounded.

In an embodiment, each of the N output modules is electrically connected to a different heating apparatus of the N heating apparatus in a one-to-one correspondence, to respectively output drive voltages to the corresponding heating apparatus.

In an embodiment, the output module further includes at least one of an adjusting unit, a current feedback unit, and a voltage feedback unit.

In one embodiment, the adjusting unit includes a power inductor and a first capacitor; a first terminal of the power inductor is electrically connected to the second connecting terminal of the first switch sub-unit to receive the drive voltage; a first terminal of the first capacitor is electrically connected to a second terminal of the power inductor, and a second terminal of the first capacitor is grounded.

In one embodiment, the voltage feedback unit includes a feedback resistor and a feedback capacitor connected in parallel with the feedback resistor; a first terminal of the feedback resistor is electrically connected to the second terminal of the power inductor, and a second terminal of the feedback resistor is grounded.

In an embodiment, the first switch sub-unit and the second switch sub-unit are both SIRA04DP chips.

The invention also provides an atomizing device, the above-mentioned voltage output circuit of the atomizing device.

In an embodiment, the atomizing device further includes N heating apparatus, each of the N heating apparatus is electrically connected to a different one of the N output modules, respectively, to respectively receiving the drive voltage output by the output module.

The beneficial effects brought by the technical solutions provided by the embodiments of the present invention are:

The voltage output circuit and the atomizing device of the invention include N (N is an integer greater than 1) output module, and each output module can output a corresponding drive voltage when receiving the corresponding control signal, such that the voltage output circuit can each provide a drive voltage to N (N is an integer greater than 1) apparatus in a device (e.g., an atomizing device) (e.g., N structurally different heating apparatus or N identically configured heating apparatus), the compatible performance is good, and since N (N is an integer greater than 1) output modules are respectively controlled by N control signals output by the processing module, the drive voltages provided by each output module may be the same or different, thereby being able to control N (N is an integer greater than 1) apparatus (for example, N different heating apparatus or N heating apparatus having the same structure) work simultaneously or alternately, and the like, and the flexibility is high.

The above description is only an overview of the technical solutions of the present invention, and the technical means of the present invention can be more clearly understood, and can be implemented according to the contents of the specification, and the above and other objects, features and advantages of the present invention can be further improved. It is obvious that the following preferred embodiments are described in detail

DRAWINGS

DETAILED DESCRIPTION OF PREFERRED EMBODIMENTS

In order to further explain the technical means and functions of the present invention for achieving the intended invention, the specific implementation manner and structure of the voltage output circuit and the device thereof according to the present invention will be described below with reference to the accompanying drawings and preferred embodiments, features and effects, as detailed below.

The above and other technical contents, features, and advantages of the present invention will be apparent from the following detailed description of the preferred embodiments. Through the description of the specific embodiments, the technical means and functions of the present invention for achieving the intended purpose can be more deeply and specifically understood, however, the attached schema is only for reference and illustration, not to limit the utility model.

First Embodiment

Figure 1:
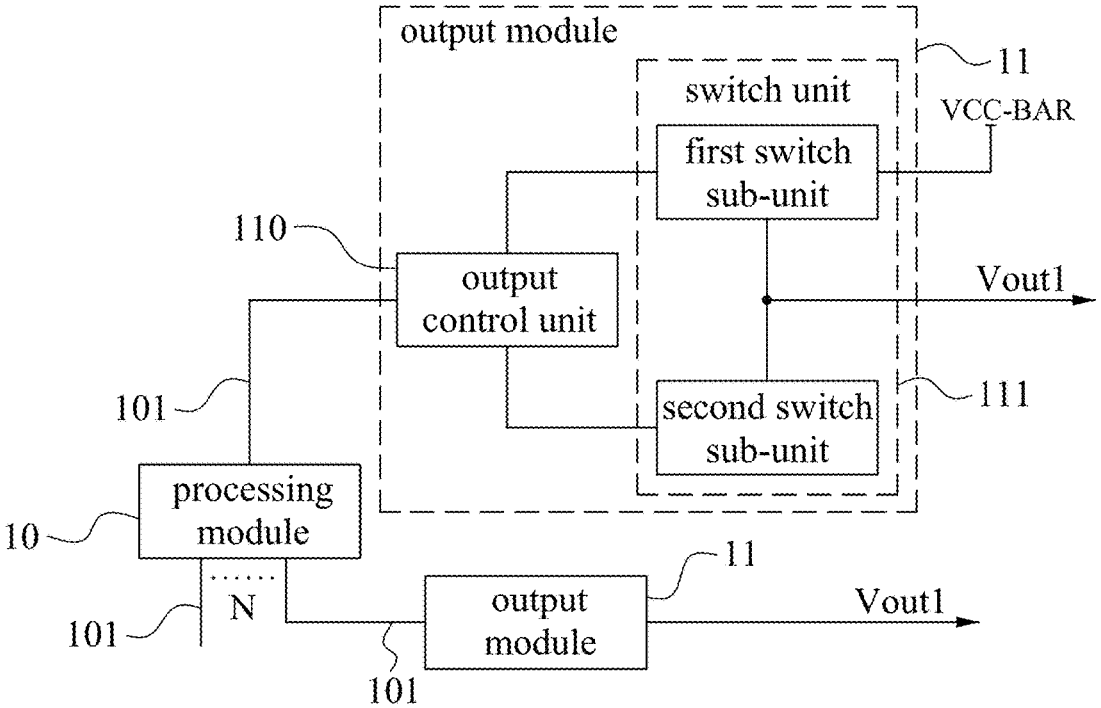
FIG. 1 is a schematic block diagram of a voltage output circuit according to a first embodiment of the present invention.

FIG. 1 is a block diagram of a voltage output circuit according to a first embodiment of the present invention. As shown in FIG. 1, the voltage output circuit includes a processing module 10 and N output modules 11 (only two are shown), and N is an integer greater than one.

The processing module 10 includes N output terminals 101. Each output terminals 101 of the processing module 10 is configured to outputting a corresponding control signal.

The output module 11 is configured to output a drive voltage Vout1 according to the control signal.

In a possible implementation, each output module 11 includes an output control unit 110 and a switch unit 111 for receiving the control signal outputted by the output terminal 101 of the processing module 10 and outputting a drive voltage Vout1 according to the control signal.

Specifically, a first input terminal of the output control unit 110 is electrically connected to the output terminals 101 of the processing module 10 to receive the control signal, and the output control unit 110 includes a third output terminal and a fourth output terminal. The switch unit 111 includes a first switch sub-unit including a first connecting terminal, a first control terminal, and a second connecting terminal, and the second switch sub-unit includes a third connecting terminal, a second control terminal and a fourth connecting terminal, the first connecting terminal receives a first DC input voltage VCC-BAR, the first control terminal is electrically connected to the third output terminal of the output control unit 110, and the second connecting terminal is electrically connected to the third connecting terminal, the second control terminal is connected to the fourth connecting terminal. The second control terminal is electrically connected to the fourth output terminal of the output control unit 110, and the fourth connecting terminal is grounded.

Specifically, when the first switch sub-unit is an NMOS transistor, the first connecting terminal is a drain, the second connecting terminal is a source, and the first control terminal is a gate. When the second switch sub-unit is an NMOS transistor, the third connecting terminal is a drain, the fourth connecting terminal is a source, and the second control terminal is a gate.

Specifically, the working principle of the output module 11 is as follows:

When the output control unit 110 receives the control signal having high level outputted by the output terminal 101 of the processing module 10, the third output terminal of the output control unit 110 outputs a high level signal, and the fourth output terminal of the output control unit 110 outputs a low level signal, and the low level signal make the first switch sub-unit of the switch unit 111 turn on, and the second switch sub-unit of the switch unit 111 turn off, so that the second connecting terminal of the first switch sub-unit of the switch unit 111 outputs the drive voltage Vout1 having a high level; when the output control unit 110 receives the control signal having low level outputted by the output terminal 101 of the processing module 10, the third output terminal of the output control unit 110 outputs a low level signal, and the fourth terminal of the output control unit 110 outputs a high level signal, so that the first switch sub-unit of the switch unit 111 is turned off, and the second switch sub-unit of the switch unit 111 is turned on, so that the second connecting terminal of first switch sub-unit of the switch unit 111 outputs a drive voltage Vout1 having low Level.

In one embodiment, the N output modules 11 of the voltage output circuit can be, but are not limited to, electrically connected to N heating apparatus (not shown) of the atomizing device, respectively, for outputting the drive voltage Vout1 to the heating apparatus.

It should be noted that, in the present invention, one output terminal of the processing module may be connected to multiple output modules, or each of the N processing modules may be in one-to-one correspondence with N output modules, that is, one output terminal is connected to one output module, and the output modules connected to each output terminal are different. When an output terminal of the processing module is connected to a plurality of output modules, the working modes of the plurality of output modules are completely synchronized; when each output terminals of the processing module is in one-to-one correspondence with the N output modules, then the working way of each output module can be the same or different.

In addition, an output module can output voltage only to one heating apparatus, and can also output voltage to a plurality of heating apparatus, which is not limited by the present invention.

Since the voltage output circuit of the embodiment includes N output modules, and each output module can output a corresponding drive voltage when receiving the control signal, the voltage output circuit can respectively provide a drive voltage to N apparatus (for example, N different heating apparatus or N heating apparatus with the same structure) of a device (for example, an atomizing device), it have good compatibility, and since the N output modules are respectively controlled by N control signals output by the processing module, the two drive voltages provided by the N output modules may be the same or different, so that N apparatus (for example, N different heating apparatus or N heating apparatus with the same structure) can be controlled to work simultaneously or alternately, high flexibility. In addition, when the two drive voltages outputted by the output module drive the heating apparatus of the N different heating modes of the atomizing device to work simultaneously, the heating apparatus of the plurality of heating modes can be simultaneously supported, and the heating efficiency of the heating apparatus can be improved and the fog can be increased. The effect is that when the N drive voltages output by the N output modules drive the N heating apparatus of the atomizing device to work alternately, the service life of the heating apparatus can be improved, and the stability of the atomizing device can be improved.

Second Embodiment

Figure 2:
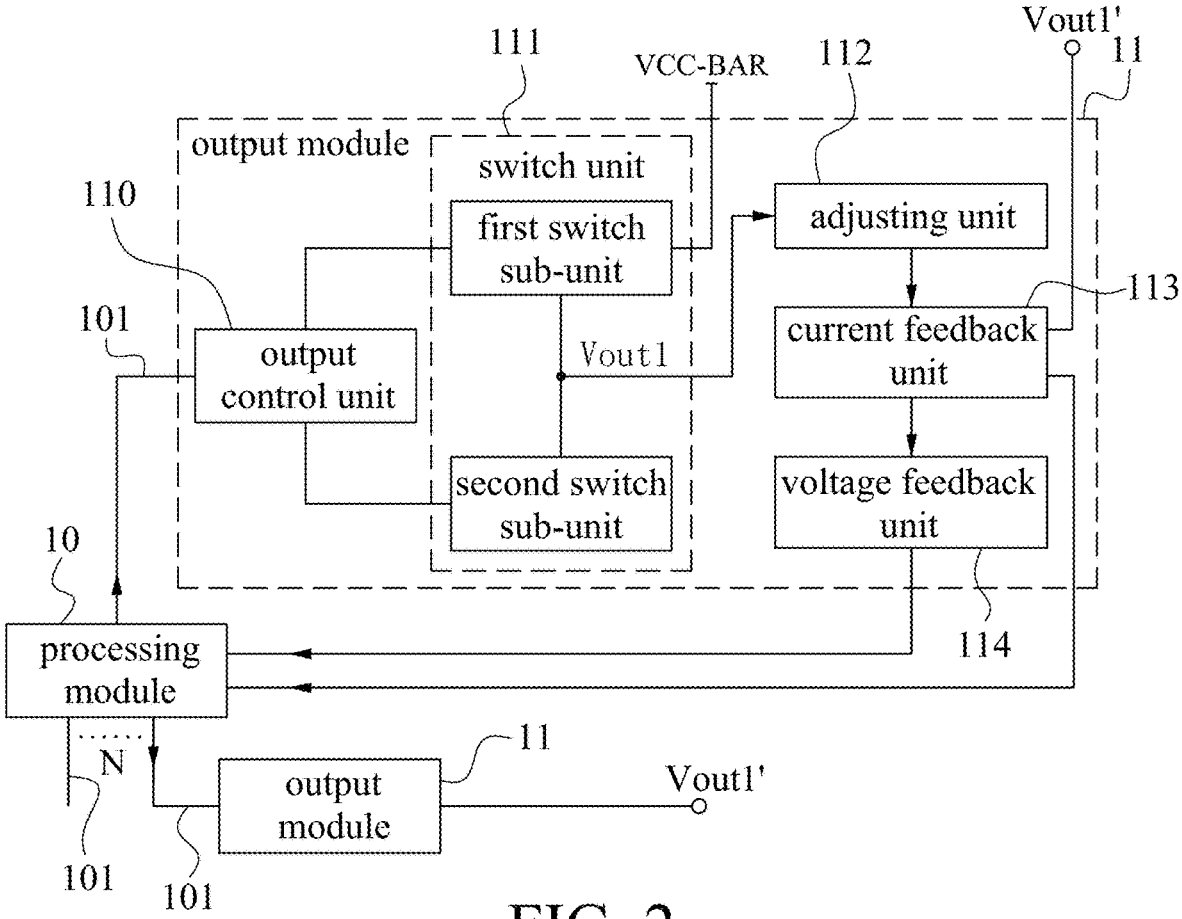
FIG. 2 is a schematic block diagram of a voltage output circuit according to a second embodiment of the present invention.

FIG. 2 is a block diagram of a voltage output circuit according to a second embodiment of the present invention. The structure of the voltage output circuit shown in FIG. 2 is basically the same as that of the voltage output circuit shown in FIG. 1 except that the output module 11 further includes an adjusting unit 112, a current feedback unit 113, and a voltage feedback unit 114.

In other embodiments, the output module 11 may also include only one or two or three of the adjusting unit 112, the current feedback unit 113, and the voltage feedback unit 114.

The adjusting unit 112 performs an adjustment (smoothing) process on the drive voltage Vout1 outputted by the second connecting terminal of the first switch sub-unit of the switch unit 111.

The current feedback unit 113 is configured to detect a first output current corresponding to the processed drive voltage Vout1' and output a current feedback signal to the processing module 10. Processing module 10 may be, for example, a micro processing chip, a central processing unit, or the like.

The voltage feedback unit 114 is configured to detect the processed drive voltage Vout1' and drive the voltage feedback signal to the processing module 10 to cause the processing module 10 to adjust the output control signal according to the current feedback signal and the voltage feedback signal.

The output module 11 of the embodiment further includes a current feedback unit 113 and a voltage feedback unit 114 to enable the processing module 10 to adjust the output according to the received current feedback signal and the voltage feedback signal, so that the voltage output circuit adjusts the output voltage value.

Third Embodiment

Figure 3:
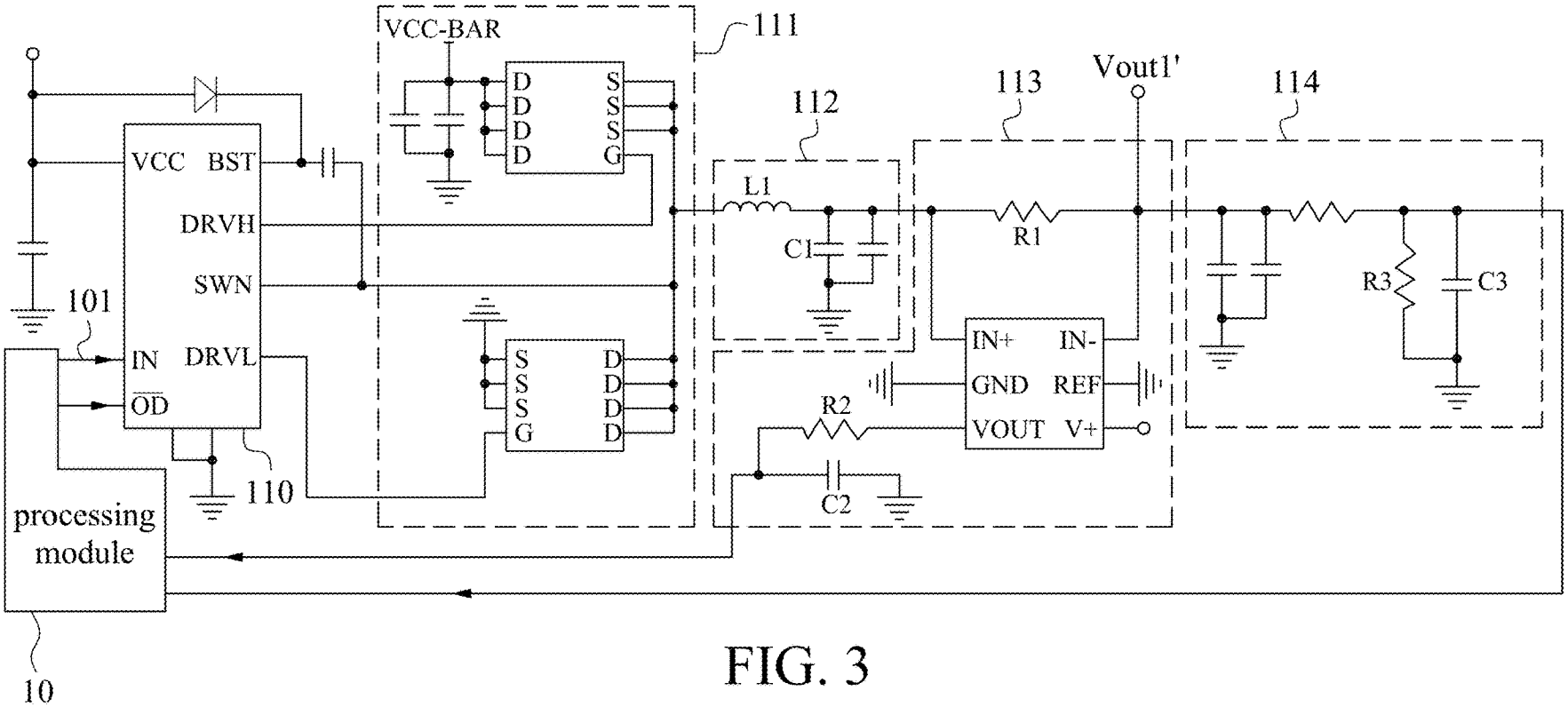
FIG. 3 is a circuit diagram of an output module according to a third embodiment of the present invention.

FIG. 3 is a schematic circuit diagram of an output module 11 according to a third embodiment of the present invention. As shown in FIG. 3, in an embodiment, the output control unit 110 is an ADP3110A chip.

Specifically, the first input terminal of the output control unit 110 is the IN pin of the ADP3110A chip, the third output terminal of the output control unit 110 is the DRVH pin of the ADP3110A chip, and the fourth output terminal of the output control unit 110 is the DRVL pin of the ADP3110A chip. When the output control unit 110 receives the control signal having high level output from the processing module 10 at the IN pin, the DRVH pin of the output control unit 110 outputs a high level signal, and the DRVL pin outputs a low level signal. When the output control unit 110 receives the low level control signal output by the processing module 10 at the IN pin, the DRVH pin of the output control unit 110 outputs a low level signal, and the DRVL pin outputs a high level signal.

Specifically, the ADP3110A chip further includes an $\overline{OD}$ pin, and the $\overline{OD}$ pin is configured to receive a control signal output by the processing module. When the processing module outputs a high level signal, the chip works normally; when the processing module outputs a low level signal, the chip's DRVH pin and DRVL pin always output low.

In an embodiment, the first switch sub-unit and the second switch sub-unit of the switch unit 111 are both SIRA04DP chips. However, the invention is not limited thereto.

Specifically, the first connecting terminal of the first switch sub-unit is a D pin (i.e., the drain of the N-channel MOS transistor), and the control terminal of the first switch sub-unit is a G pin (i.e., a gate of the N-channel MOS transistor), the second connecting terminal of the first switch sub-unit is an S pin (i.e., a source of the N-channel MOS transistor). The third connecting terminal of the second switch sub-unit is a D pin (i.e., the drain of the N-channel MOS transistor), and the control terminal of the second switch sub-unit is a G pin (i.e., the gate of the N-channel MOS transistor), the fourth connecting terminal of the second switch sub-unit is an S pin (i.e., a source of the N-channel MOS transistor).

Specifically, when the G pin of the first switch sub-unit receives the high level signal outputted by the DRVH pin of the output control unit 110, the first switch sub-unit is turned on. When the G pin of the second switch sub-unit receives the low level signal outputted by the DRVL pin of the output control unit 110, the second switch sub-unit is turned off, so that the switch unit 111 outputs the drive voltage Vout1 having high level.

Specifically, when the G pin of the first switch sub-unit receives the low level signal output by the DRVH pin of the output control unit 110, the first switch sub-unit is turned off. When the G pin of the second switch sub-unit receives the high level signal output from the DRVL pin of the output control unit 110, the second switch sub-unit is turned on, so that the switch unit 111 outputs the drive voltage Vout1 having low level.

In an embodiment, the adjusting unit 112 is configured to perform an adjustment process on the drive voltage Vout1 to generate a processed drive voltage Vout1' to obtain a smooth continuous driving current. The adjusting unit 112 includes a power inductor L1 and a first capacitor C1. The first terminal of the power inductor L1 is electrically connected to the second connecting terminal (i.e., the S pin) of the first switch sub-unit to receive the drive voltage Vout1. The first terminal of the first capacitor C1 is electrically connected to the second terminal of the power inductor L2, and the second terminal of the first capacitor C1 is grounded.

In one embodiment, the current feedback unit 113 includes an INA199A1 chip, and a peripheral sub-unit of the INA199A1 chip. The peripheral sub-unit includes a first resistor R1, a second resistor R2, and a second capacitor C2.

Specifically, INA199A1 chip includes IN+ pin, IN− pin and VOUT pin. INA199A1 chip's IN+ pin is connected to the second terminal of power inductor L1, and IN− pin is connected to the second terminal of power inductor L1 through the first resistor R1.

The first terminal of the second resistor R2 is connected to the VOUT pin of the INA199A1 chip, the second terminal of the second resistor R2 is connected to the first terminal of the second capacitor C2 and the processing module 10, and the second terminal of the second capacitor C2 is grounded.

In one embodiment, the voltage feedback unit 114 includes a feedback resistor R3 and a feedback capacitor C3 in parallel with the feedback resistor R3. The first terminal of the feedback resistor R3 is electrically connected to the second terminal of the power inductor L1, and the second terminal of the feedback resistor R3 is grounded.

Fourth Embodiment

Figure 4:
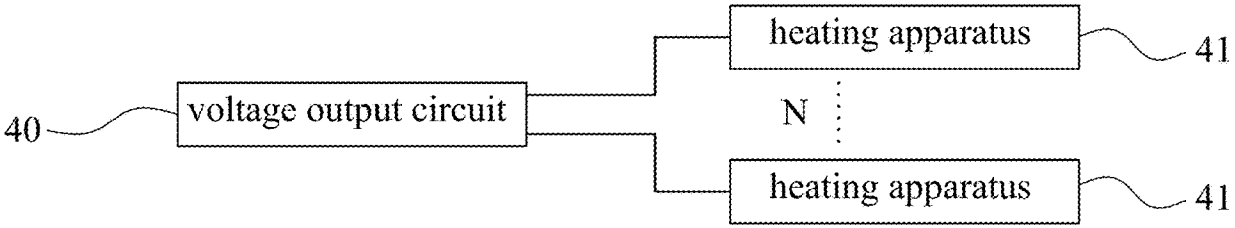
FIG. 4 is a schematic block diagram of an atomizing device according to a fourth embodiment of the present invention.

FIG. 4 is a schematic block diagram of an atomizing device according to a fourth embodiment of the present invention. The invention also provides an atomizing device, which includes a voltage output circuit 40. For the specific structure and working principle of the voltage output circuit, please refer to FIG. 1, FIG. 2, FIG. 3 and related descriptions, and details are not described herein again.

In an embodiment, the atomizing device further includes N heating apparatus 41.

Specifically, the heating mode of each heating apparatus 41 may be the same or different.

When the output terminal 101 of the processing module 10 outputs a high level control signal, the output module 11 outputs a high level drive voltage Vout1; when the output terminal 101 of the processing module 10 outputs a low level control signal, the output module 11 outputs a low level drive voltage Vout1.

The heating apparatus 41 receives the drive voltage Vout1 outputted by the output module 11 to control the operation of the heating apparatus 41, so that the atomizing device outputs smoke to realize the smoking function. Of course, the drive voltage Vout1 outputted by the output module 11 can be, but is not limited to, output to other fogs. The device of the device is, for example, a display device or the like. Of course, the present invention is not limited thereto.

The atomizing device of the present embodiment uses the voltage output circuit 40 to respectively output N drive voltages to the N heating apparatus 41, and the heating modes of the N heating apparatus 41 may be the same or different. Therefore, the heating apparatus with N kinds of heating methods can be used in the atomizing device of the embodiment, the compatibility is good, and since the N kinds of heating apparatus are independently controlled, the N kinds of heating apparatus can work at the same time or at different times, for example, alternately, and the flexibility is high.

The voltage output circuit and the atomizing device of the invention include N (N is an integer greater than 1) output module, and each output module can output a corresponding drive voltage when receiving the corresponding control signal, such that the voltage output circuit can each provide a drive voltage to N (N is an integer greater than 1) apparatus in a device (e.g., an atomizing device) (e.g., N structurally different heating apparatus or N identically configured heating apparatus), the compatible performance is good, and since N (N is an integer greater than 1) output modules are respectively controlled by N control signals output by the processing module, the drive voltages provided by each output module may be the same or different, thereby being able to control N (N is an integer greater than 1) apparatus (for example, N different heating apparatus or N heating apparatus having the same structure) work simultaneously or alternately, and the like, and the flexibility is high.

The above is only a preferred embodiment of the present invention, and is not intended to limit the present invention in any way. Although the present invention has been disclosed above in the preferred embodiments, it is not intended to limit the present invention. Those skilled in the art can make some modifications or modifications to equivalent embodiments by using the above-disclosed technical contents without departing from the scope of the present invention. Any simple modifications, equivalent changes and modifications made to the above embodiments in accordance with the technical spirit of the present invention are still within the scope of the technical solutions of the present invention.

What is claimed is:

1. A voltage output circuit, wherein the voltage output circuit comprises a processing module and N output modules, N is an integer greater than one;

the processing module comprises N output terminals, and each of the N output terminals of the processing module is respectively connected to a different one of the N output modules, and the N output terminals of the processing module are respectively configured to output a control signal to control a corresponding output module output drive voltage;

wherein each of the output modules comprises an output control unit and a switch unit, and the output control unit is electrically connected to the switch unit, and configured to output the drive voltage according to the control signal outputted by the output terminal of the processing module;

a first input terminal of the output control unit is electrically connected to the output terminals of the processing module to receive the control signal, and the output control unit comprises a third output terminal and a fourth output terminal;

the switch unit receives a first DC input voltage and is connected to the third output terminal and the fourth output terminal to output the drive voltage.

2. The voltage output circuit according to claim 1, wherein the switch unit comprises a first switch sub-unit and a second switch sub-unit, and the first switch sub-unit comprises a first connecting terminal, a first control terminal, and a second connecting terminal, and the second switch sub-unit comprises a third connecting terminal, a second control terminal, and a fourth connecting terminal, the first connecting terminal receiving the first DC input voltage, the first control terminal is electrically connected to the third output terminal of the output control unit, the second connecting terminal is electrically connected to the third connecting terminal, the second control terminal is electrically connected to the fourth output terminal of the output control unit, and the fourth connecting terminal is grounded.

3. The voltage output circuit according to claim 1, wherein, each of the N output modules is electrically connected to a different heating apparatus of the N heating apparatus in a one-to-one correspondence, to respectively output drive voltages to the corresponding heating apparatus.

4. The voltage output circuit according to claim 2, wherein the output module further comprises at least one of an adjusting unit, a current feedback unit, and a voltage feedback unit.

5. The voltage output circuit according to claim 4, wherein the adjusting unit comprises a power inductor and a first capacitor; a first terminal of the power inductor is electrically connected to the second connecting terminal of the first switch sub-unit to receive the drive voltage;

a first terminal of the first capacitor is electrically connected to a second terminal of the power inductor, and a second terminal of the first capacitor is grounded.

6. The voltage generating circuit according to claim 5, wherein the voltage feedback unit comprises a feedback resistor and a feedback capacitor connected in parallel with the feedback resistor; a first terminal of the feedback resistor is electrically connected to the second terminal of the power inductor, and a second terminal of the feedback resistor is grounded.

7. The voltage output circuit according to claim 2, wherein the first switch sub-unit and the second switch sub-unit are both SIRA04DP chips.

8. An atomizing device, wherein the atomizing device comprises the voltage output circuit according to claim 1;

wherein each of the output modules comprises an output control unit and a switch unit, and the output control unit is electrically connected to the switch unit, and configured to output the drive voltage according to the control signal outputted by the output terminal of the processing module;

a first input terminal of the output control unit is electrically connected to the output terminals of the processing module to receive the control signal, and the output control unit comprises a third output terminal and a fourth output terminal;

the switch unit receives a first DC input voltage and is connected to the third output terminal and the fourth output terminal to output the drive voltage.

9. The atomizing device according to claim 8, wherein the atomizing device further comprises N heating apparatus, each of the N heating apparatus is electrically connected to a different one of the N output modules, respectively, to respectively receiving the drive voltage output by the output module.

10. The atomizing device according to claim 8, wherein the switch unit comprises a first switch sub-unit and a second switch sub-unit, and the first switch sub-unit comprises a first connecting terminal, a first control terminal, and a second connecting terminal, and the second switch sub-unit comprises a third connecting terminal, a second control terminal, and a fourth connecting terminal, the first connecting terminal receiving the first DC input voltage, the first control terminal is electrically connected to the third output terminal of the output control unit, the second connecting terminal is electrically connected to the third connecting terminal, the second control terminal is electrically connected to the fourth output terminal of the output control unit, and the fourth connecting terminal is grounded.

11. The atomizing device according to claim 8, wherein each of the N output modules is electrically connected to a different heating apparatus of the N heating apparatus in a one-to-one correspondence, to respectively output drive voltages to the corresponding heating apparatus.

12. The atomizing device according to claim 10, wherein the output module further comprises at least one of an adjusting unit, a current feedback unit, and a voltage feedback unit.

13. The atomizing device according to claim 12, wherein the adjusting unit comprises a power inductor and a first capacitor; a first terminal of the power inductor is electrically connected to the second connecting terminal of the first switch sub-unit to receive the drive voltage;

a first terminal of the first capacitor is electrically connected to a second terminal of the power inductor, and a second terminal of the first capacitor is grounded.

14. The atomizing device according to claim 13, wherein the voltage feedback unit comprises a feedback resistor and a feedback capacitor connected in parallel with the feedback resistor; a first terminal of the feedback resistor is electrically connected to the second terminal of the power inductor, and a second terminal of the feedback resistor is grounded.

15. The atomizing device according to claim 10, wherein the first switch sub-unit and the second switch sub-unit are both SIRA04DP chips.

* * * * *